US012471746B2

(12) United States Patent
Cleff

(10) Patent No.: US 12,471,746 B2
(45) Date of Patent: Nov. 18, 2025

(54) VACUUM CLEANER NOZZLE

(71) Applicant: Wessel-Werk GmbH, Reichshof-Wildbergerhuette (DE)

(72) Inventor: Marcus Cleff, Cologne (DE)

(73) Assignee: Wessel-Werk GmbH, Reichshof-Wildbergerhuette (DE)

( * ) Notice: Subject to any disclaimer, the term of this patent is extended or adjusted under 35 U.S.C. 154(b) by 343 days.

(21) Appl. No.: 18/212,234

(22) Filed: Jun. 21, 2023

(65) Prior Publication Data

US 2023/0414049 A1 Dec. 28, 2023

(30) Foreign Application Priority Data

Jun. 22, 2022 (DE) ..... 10 2022 115 600.1

(51) Int. Cl.

| | |
|---|---|
| ***A47L 9/02*** | (2006.01) |
| ***A46B 9/02*** | (2006.01) |
| ***A47L 9/06*** | (2006.01) |
| *A46B 13/00* | (2006.01) |
| *A46B 13/02* | (2006.01) |
| *A47L 9/04* | (2006.01) |

(52) U.S. Cl.

CPC ..... *A47L 9/0606* (2013.01); *A46B 9/02* (2013.01); *A46B 13/001* (2013.01); *A46B 13/02* (2013.01); *A46B 2200/3033* (2013.01); *A47L 9/0477* (2013.01); *A47L 9/0488* (2013.01)

(58) Field of Classification Search

CPC ..... A47L 9/00; A47L 9/02; A47L 9/06; A46B 13/02

See application file for complete search history.

(56) References Cited

U.S. PATENT DOCUMENTS

| | | | | |
|---|---|---|---|---|
| 4,282,626 | A | 8/1981 | Schneider | |
| 2010/0154150 | A1* | 6/2010 | Mcleod | A47L 9/02 15/21.1 |
| 2013/0319469 | A1* | 12/2013 | Borges, Sr. | A47L 9/06 134/21 |

FOREIGN PATENT DOCUMENTS

| | | | |
|---|---|---|---|
| DE | 78 25 557 | U1 | 8/1979 |
| DE | 43 44 596 | A1 | 6/1995 |
| DE | 10 2013 223 863 | A1 | 5/2015 |
| DE | 10 2017 118 487 | A1 | 2/2019 |
| DE | 10 2018 133 540 | A1 | 6/2020 |

* cited by examiner

*Primary Examiner* — Michael D Jennings
(74) *Attorney, Agent, or Firm* — Collard & Roe, P.C.

(57) ABSTRACT

A vacuum cleaner nozzle includes a housing with, formed on an underside of the housing and extending in a transverse direction, a suction orifice that is bounded by what in a working direction aligned perpendicular to the transverse direction is a front suction-orifice edge and by what in the working direction is a rear suction-orifice edge, with a suction duct disposed in the housing and adjoining the suction orifice, with a suction port extension, which is also fluidically in communication with the suction duct and is disposed, relative to the working direction, on a rear side of the housing. The vacuum cleaner nozzle further includes a secondary air aperture disposed in front of the suction orifice and fluidically in communication with the suction duct. The secondary air aperture is at least partly covered by a flexible textile valve element.

16 Claims, 3 Drawing Sheets

VACUUM CLEANER NOZZLE

CROSS REFERENCE TO RELATED APPLICATIONS

Applicant claims priority under 35 U.S.C. § 119 of German Application No. 10 2022 115 600.1 filed Jun. 22, 2022, the disclosure of which is incorporated by reference.

BACKGROUND OF THE INVENTION

1. Field of the Invention

The invention relates to a vacuum cleaner nozzle comprising a housing with a suction orifice formed on an underside of the housing and extending in a transverse direction. The suction orifice is bounded by what in a working direction aligned perpendicular to the transverse direction is a front suction-orifice edge and by what in the working direction is a rear suction-orifice edge. The vacuum cleaner nozzle further comprises a suction duct disposed in the housing and, adjoining the suction orifice, a suction port extension that is fluidically in communication with the suction duct and is disposed, relative to the working direction, on a rear side of the housing, as well as a secondary air aperture disposed in the housing in front of the suction orifice and fluidically in communication with the suction duct.

2. Description of the Related Art

A vacuum cleaner nozzle is intended to shape the suction air stream of a vacuum unit, especially of a household vacuum cleaner, and to guide it in advantageous manner past a surface to be cleaned—for example, a floor area. For this purpose, the vacuum cleaning unit comprises a blower for generation of the suction air stream as well as at least one collecting device for separation of dirt particles entrained in the suction air stream. In particular, the collection device may comprise centrifugal collectors and/or filters such as, for example, filter fleeces or filter bags.

In particular, the vacuum unit may be connected detachably with the suction port extension of the vacuum cleaner nozzle. Due to the blower, a negative pressure is then generated that extends into the suction duct. Thereby the interior of the suction duct has a lower pressure level than the surroundings around the vacuum cleaner nozzle. The suction duct can be reached fluidically from the surroundings via the suction orifice as well as the secondary air aperture.

By virtue of the prevailing negative pressure, during operation both a first partial stream and a second partial stream—which is also referred to as the secondary air stream—of the suction air stream flow into the interior of the suction duct, the first through the suction orifice and the second through the secondary air aperture. From there, the first and the second partial streams are extracted in the direction of the vacuum unit.

For reduction of the needed energy, household vacuum cleaners with only an electrical power of 800 W or less are still being offered increasingly on the market. Accordingly, it is also possible to provide only a lower physical suction power (negative pressure×volume flow) for cleaning. This lower physical suction power makes an increasing optimization of the geometry of vacuum cleaner nozzles necessary, in order to continue to achieve good cleaning results.

In order to concentrate the cleaning action on the surface to be cleaned, the air gap between the underside of the housing—in particular the suction orifice—and the surface to be cleaned is then dimensioned very small (in the range of a few millimeters). Similarly, during cleaning of air-permeable materials, especially of textile type, it is likewise customary to bring the underside of the vacuum cleaner nozzle into direct contact with the material to be cleaned. In both cases, the danger of "seizing by suction" exists. In such cases, the air resistance becomes so high that the suction air stream through the suction orifice dies out almost completely. Consequently, the cleaning action decreases while the danger of damage to the floor simultaneously increases.

So-called secondary air apertures are known in order to counter this problem. These apertures form an alternative flow path, so that, even in the case of seizing by suction of the suction orifice as the main suction aperture, air transport takes place at least within the scope of the secondary air stream and it is possible to reduce the negative pressure present in the suction duct. Due to the lower negative pressure, the force of contact of the vacuum cleaner nozzle on the surface to be cleaned is reduced, which diminishes both the danger of damage and the resistance to pushing.

Static secondary air apertures, however, have the disadvantage that part of the suction air stream and thus of the available suction energy is lost even in cases in which these apertures are not necessary. For this reason, secondary air apertures are usually equipped with manually or automatically actuatable secondary air aperture valves. These valves usually work in such a way that the valves are closed in the normal working condition and the secondary air path is thereby closed. Only upon attainment of a negative pressure of certain magnitude do the secondary air valves open automatically (or by user action), whereby the secondary air path is opened and the negative pressure in the suction duct is reduced.

Automatic secondary air valves, however, also suffer from inherent problems. These valves usually consist of valve flaps, which can be transferred from a closed to an open position by the negative pressure—the pressure difference between the suction duct and the surroundings around the vacuum cleaner nozzle. In this context, especially spring-loaded rigid flaps as well as deformable elastic flaps are known.

Disadvantageously, however, these flaps, especially in the open condition, are set into a fluttering motion by the secondary air stream. This motion is accompanied by a not inconsiderable noise generation. Even the "switching" between the open and closed positions is regularly accompanied by noises that are annoying for the user. In particular, therefore, automatic secondary air apertures are used to a limited extent only in high-end vacuum cleaner nozzles.

It is further disadvantageous that the secondary air stream is usually sucked in unproductively, i.e. without transport of dirt particles. This unproductive transport of dirt particles is also undesirable because the dirt particles are particularly likely to interfere with or damage the automatic adjustment mechanism of the secondary air valve. Depending on size and condition of the automatic secondary air valve, it may become clogged, for example due to coarse dirt. Similarly, flexible valve flaps may become damaged by action of dirt particles, so that they no longer close completely sealingly. Even rigid valve flaps may become blocked with dirt particles in either an open or closed position, so that the secondary air mechanism is no longer functional.

SUMMARY OF THE INVENTION

Against this background, the task underlying the invention is to specify a vacuum cleaner nozzle having an improved automatic secondary air valve. It is intended to make this secondary air valve less sensitive to damage and malfunctions caused by dirt particles. At the same time, it is intended to reduce the noise generation during operation.

Subject matter of the invention and accomplishment of this task is a vacuum cleaner nozzle according to one aspect of the invention. Preferred configurations are discussed below.

Starting from the generic vacuum cleaner nozzle, it is provided according to the invention that the secondary air aperture is at least partly covered or closable by a flexible textile valve element. In contrast to conventional valve flaps, a textile valve element is characterized in that a component controlling the secondary air stream is composed of a fibrous structure—a textile.

Compared to a monolithic valve flap, such a textile valve element composed of a fibrous structure has the advantage that dirt particles of various sizes are able to pass substantially unhindered through the textile. From small dust particles in the range of some 10 to 100 μm to coarse dirt particles with diameters beyond 1 mm and up to approximately 5 mm, many fractions of the dirt entrained in the secondary air stream are able to pass through the valve element.

No disturbing impact noises result even during impingement of dirt particles, especially large ones, on the valve element, because the individual dirt particle always comes into contact with only a few fibers of the valve element at the same time. Even noises during discrete aperture/closing of the valve element disappear compared to a rigid valve flap, because a "soft" aperture characteristic results, in which the secondary air stream increases almost continuously. Even the development of flow noise is strongly damped, because this noise is both greatly reduced and shifted into an imperceptible frequency range due to the textile nature of the valve element.

Quite generally, it is preferably provided that the fibers of the textile valve element of the bristle strip(s) are aligned, especially approximately perpendicular to a flow direction of the secondary air aperture. In particular in this respect, they are inclined inward, i.e. in the flow direction by a small angle—between 0° and 10°. Relative to the secondary air stream, the fastening of these fibers is situated upstream from the fibers or their free ends.

Preferably, the secondary air aperture is slot-shaped. This slot-shape means the extent of the aperture in a first direction is at least five times, especially at least ten times, greater than the extent in a second direction perpendicular thereto. Preferably, this first direction is aligned parallel to the transverse direction of the vacuum cleaner nozzle. In this case, the secondary air aperture preferably extends over at least 75%, especially at least 90%, of the maximum width of the housing in the transverse direction (nozzle width). Alternatively, several similar secondary air apertures, which together make up at least 75% or at least 90% of the nozzle width, may be distributed next to one another.

According to a preferred configuration of the invention, the secondary air aperture is formed in an end face of the housing. This end face forms the closure of the housing on what is the front side—i.e. the side facing away from the suction port extension—in the working direction. Due to the arrangement in this region, it is possible in particular to pick up dirt present in front of the vacuum cleaner nozzle with the secondary air stream. This ability is made possible or made simple to achieve for the first time by the textile configuration of the valve element according to the invention.

Quite particularly preferably, the secondary air aperture—on the outside of the housing—is bounded by a circumferential rim that extends exclusively in a plane oriented perpendicular to the working direction (aperture plane). Due to the alignment in this frontal plane, the flow direction of the secondary air stream is aligned substantially parallel to the working direction, which further promotes the aspiration of dirt particles.

According to a particularly preferred configuration, the secondary air aperture is directly adjacent to the suction duct. In this way the secondary air aperture is formed as an opening in a wall, which simultaneously forms an outer side of the housing and a boundary of the suction duct.

According to a particularly preferred configuration, the secondary air aperture has a minimum height of no more than 4 mm relative to a support plane of the vacuum cleaner nozzle. This support plane is substantially aligned with a flat floor area, on which the vacuum cleaner nozzle is placed (without push or pull torques). In normal cleaning use, the distance to the support plane thus corresponds to the height above the floor. Due to this arrangement of the secondary air aperture close to the floor, especially the capture of coarse dirt in front of the vacuum cleaner nozzle is simplified. Thus, this dirt can be sucked up before it comes into contact with the vacuum cleaner nozzle. Similarly, dirt particles can be picked up that are pushed in front of the vacuum cleaner nozzle and piled up if necessary.

Preferably, it is provided that the flexible textile valve element has a large number of fibers, for example more than 50 fibers. The fibers form the base layer of a textile valve element. The fibers may be bent elastically, especially under the action of external forces, and may assume a rest position once again after the cessation of external forces. According to a particularly preferred configuration, the fibers are formed in loop-free manner. By loop-free is meant that each of the fibers projects with at least one freely protruding end into the secondary air path and at the opposite end or between two freely protruding ends is fixed on a carrier. Due to the absence of loops, it is ensured that no dirt particles are able to become trapped in them.

According to a preferred configuration, the fibers have a fineness of at most 4 dtex, especially 2 to 4 dtex. On the one hand, these particularly fine fibers permit a good sealing of the suction duct at low negative pressure. At the same time, the passage of dirt particles is facilitated.

In order to achieve a particularly good sealing, a bundle density of at least 50 fibers per square millimeter ($mm^2$), preferably at least 100 fibers per $mm^2$, especially at least 200 fibers per $mm^2$, is preferably provided. In appearance and sealing properties, a fiber arrangement with such a high bundle density progressively approaches a continuous sealing lip, while the advantages according to the invention are preserved.

According to a preferred configuration, at least some of the fibers are disposed without gaps and are aligned parallel to one other in a first bristle strip. The gathering into a bristle strip facilitates the manufacture and use of the fibers. Particularly preferably, the bristle strip has at least one carrier, on which the fibers are held—especially in glued and/or clamped manner.

Preferably, the flexible textile valve element has at least one second bristle strip with fibers aligned parallel to one other without gaps. Thereby the valve element may be composed of multiple textile elements according to the invention in a single secondary air aperture.

Preferably, the alignment of the fibers of the first bristle strip includes an angle of at least 120°, especially 145°, with the alignment of the fibers of the second bristle strip. Quite particularly preferably, it is provided that the fibers of the first bristle strip and the fibers of the second bristle strip are aligned antiparallel to one another. Thereby it is possible that the textile sealing element is able to extend—into the flow—up to the middle from two opposite sides of the rim of a secondary air aperture.

In the unstressed/no-flow condition, the fibers of the first bristle strip and of the second bristle strip preferably end at a distance of less than 1 mm from one other.

According to a preferred configuration, the fibers are aligned perpendicular to the flow direction—i.e. especially within the aperture plane or perpendicular to the working direction.

Quite particularly preferably, it is provided that the flexible textile valve element completely closes off the secondary air aperture, at least in the unstressed condition.

In order to facilitate the passage of larger dirt particles, it is provided according to a preferred configuration that the flexible textile valve element has an extent of no more than 2 mm, preferably no more than 1 mm, in the flow direction or in the working direction.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
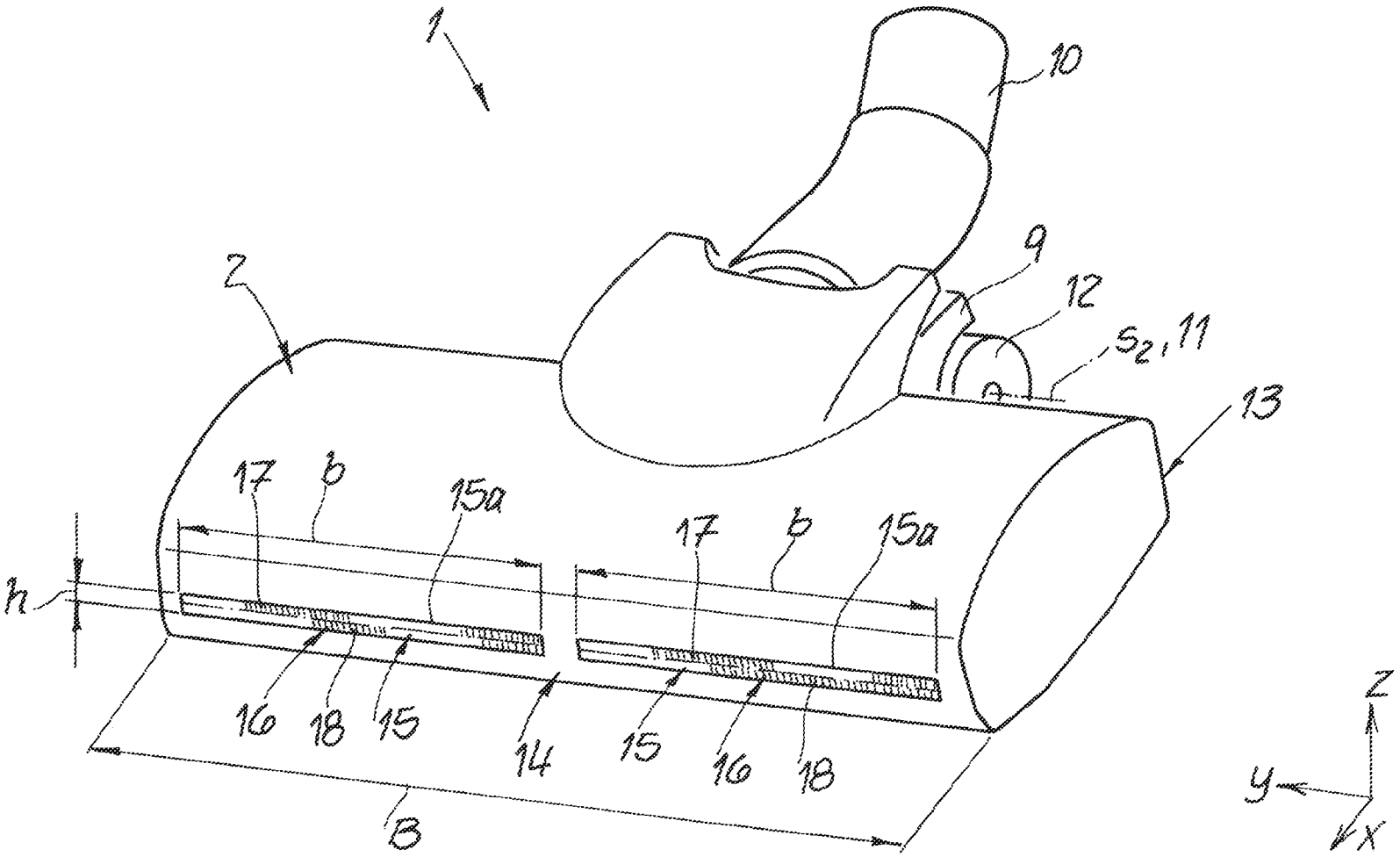
FIG. 1 shows a perspective diagram of a vacuum cleaner nozzle according to the invention.

FIG. 1 shows a vacuum cleaner nozzle 1 with a housing 2. The housing 2 extends in a working direction x, in a transverse direction y aligned perpendicular to the working direction x, and in a vertical direction z oriented perpendicular to the working direction x and the transverse direction y. From a comparative examination with FIG. 2A, it is apparent that a suction orifice 3 is formed on an underside—with respect to the vertical direction z—of the housing 2, and extends in the transverse direction y over substantially the entire width B of the housing 2. In the working direction x, this suction orifice 3 is bounded by a front suction orifice edge 4 and a rear suction orifice edge 5. Within the housing 2, a suction duct 6, in which a brush roller 7 is received, is connected from above in the vertical direction z to the suction orifice 3. This brush roller 7 is driven rotatably around an axis of rotation 8 extending in the transverse direction y. The suction duct 6 may be referred to alternatively as a brush chamber.

Furthermore, the suction duct 6 is fluidically in communication with a suction port extension 10 via an intermediate piece 9. For this purpose, the suction port extension 10 is set up to be connected to a suction line of a vacuum cleaning unit. Thus a negative pressure generated in the vacuum cleaning unit is propagated through the suction port extension 10 and the intermediate piece 9 into the suction duct 6. For this purpose, the fluidic communication between the suction duct 6 and the suction port extension 10—in the present exemplary embodiment having an intermediate piece 9—is constructed to be substantially leak-tight. This substantially leak-tight construction means that no substantial air infiltration, especially of greater than 5% of the suction air stream, occurs between the suction duct 6 and the suction port extension 10 or a suction line connected to it.

In the illustrated exemplary embodiment, the vacuum cleaner nozzle 1 is designed as a so-called double-jointed nozzle. This double-jointed nozzle design means that the intermediate piece 9 is connected to the housing 2 in swiveling relationship around a first tilt axis $s_1$, while the suction port extension 10 is hinged to the intermediate piece 9 in swiveling relationship around a second tilt axis $s_2$. In this case, the first tilt axis $s_1$ and the second tilt axis $s_2$ are aligned parallel to the transverse direction y. Furthermore, the second tilt axis $s_2$ coincides with the axis of rotation 11 of running rollers 12, which are fastened to the rear side of the intermediate piece 9. Via the intermediate piece 9, this suction port extension 10 is disposed, relative to the working direction x, indirectly on a rear side 13 of the housing 2.

Two secondary air apertures 15 are formed on the front 14 of the housing 2—in front of the front suction orifice edge 4. On the outside of the housing 2, each secondary air aperture 15 is bounded by a circumferential rim 15*a* that extends exclusively in a plane $n_x$ oriented perpendicular to the working direction x. See FIGS. 2B and 2C. The secondary air apertures 15 are formed in slot-shaped manner and have a width b that exceeds their height h by more than five times. At the same time, the two secondary air apertures 15 extend substantially over the entire width B of the vacuum cleaner nozzle 1 and in total make up more than 90% of the nozzle width B.

According to the invention, the secondary air apertures 15 are at least partly covered by a flexible textile valve element 16.

Figure 2A:
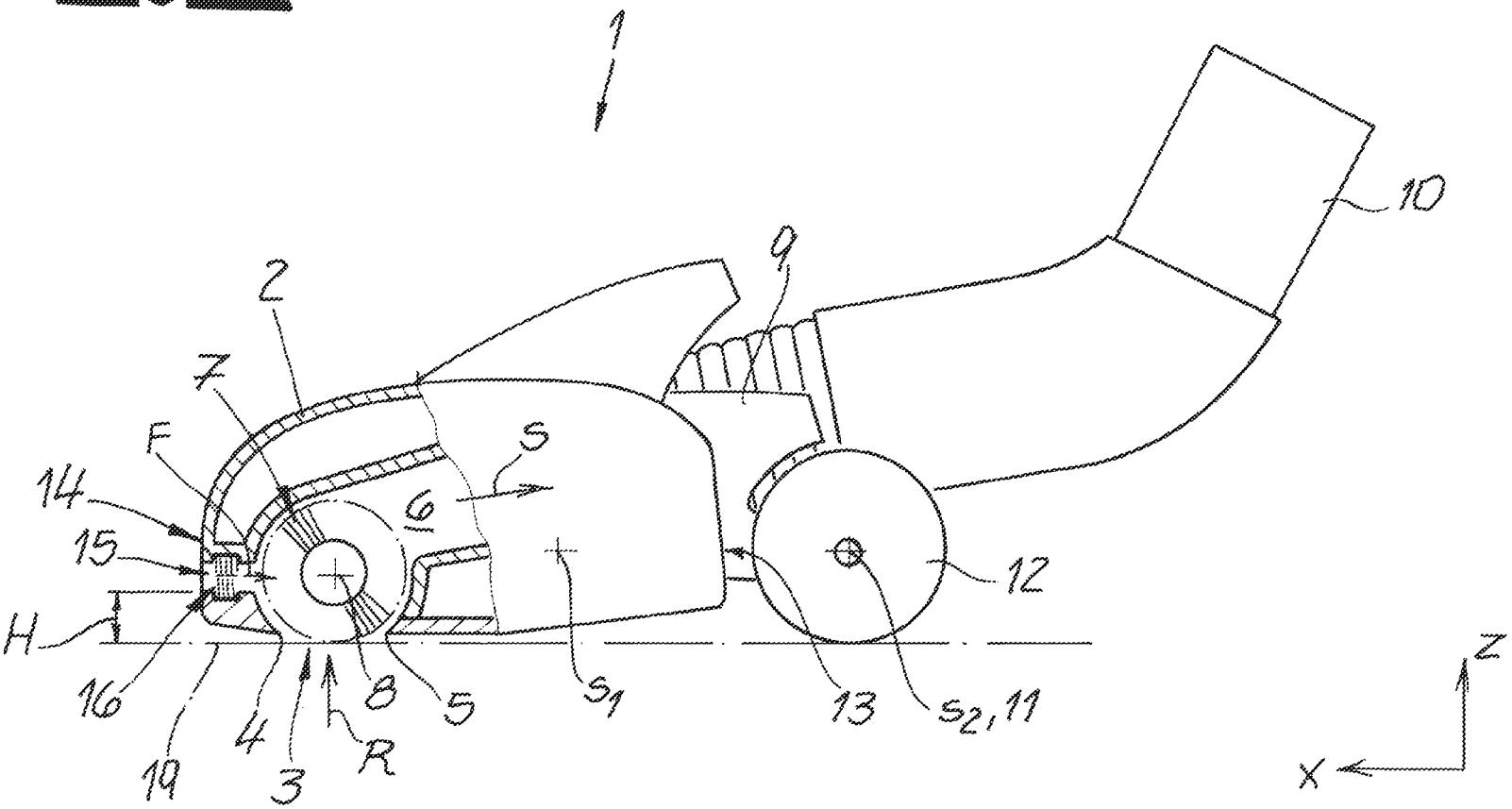
FIG. 2A shows a longitudinal section through the vacuum cleaner nozzle according to FIG. 1.
Figure 2B:
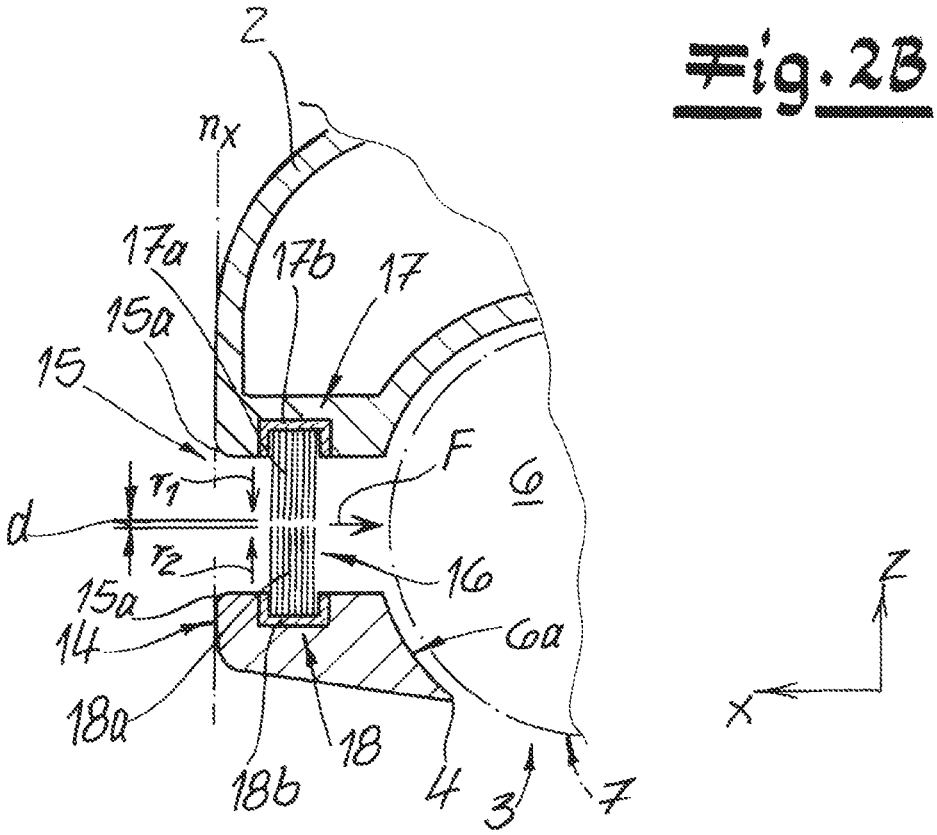
FIG. 2B shows a detail from FIG. 2A.

As can be inferred from the enlarged detail of FIG. 2B, the flexible textile valve element 16 has a first bristle strip 17 and a second bristle strip 18. In this regard, the first bristle strip 17 comprises a first subset of fibers 17*a* that are disposed side by side without interruption (in the working direction x and the transverse direction y) and are aligned in a first direction $r_1$ opposite to the vertical direction z. The fibers 17*a* of the first bristle strip 17 are gripped at one end with a first carrier 17*b*, and are clamped and bonded thereon for fastening purposes. In this case, the free ends of the fibers 17*a* opposite the carrier 17*b* protrude into the secondary air aperture 15 perpendicular to the flow direction F and end there approximately at the middle.

Analogously, the second bristle strip 18 has a second set of fibers 18*a* disposed side by side without gaps and aligned in a second direction $r_2$. In this case, the first direction r1 and the second direction $r_2$ are aligned antiparallel. The fibers 18*a* of the second bristle strip 18 are also gripped at the ends and held on the housing 2 by a second carrier 18*b*. The opposite free ends of the second bristle strip 18 also project into the secondary air apertures 15 approximately at right angles to the flow direction F and end at a distance d of less than 1 mm from the free ends of the opposite fibers 17*a* of the first bristle strip 17. Thereby the secondary air aperture 15 is almost completely closed by the flexible textile sealing element 16.

In suction mode, a negative pressure is generated in suction duct 6 by a vacuum cleaning unit. This unit generates primarily a cleaning air stream R, which enters the suction duct 6 through the suction orifice 3. Depending on the prevailing pressure conditions, an air stream entering the housing 2 through the secondary air aperture 15 is also established in the flow direction F. This secondary air stream is united in the suction duct 6 with the cleaning air stream R and is exhausted together with it as suction air stream S in the direction of the suction port extension 10.

Due to the static and dynamic pressure drop across the flexible textile sealing element 16, the fibers 17*a*, 18*a* are bent inward in the flow direction F, whereby they uncover the secondary air aperture 15 at least partly. Dirt particles and coarse dirt particles are able to pass through this aperture as well as through, and also be captured by, the bristle strips 17, 18 formed as fibers 17*a*, 18*a*. In order to facilitate vacuuming of coarse dirt particles piled up in front of the housing 2, the secondary air apertures 15 are disposed above a support plane 19 of the vacuum cleaner nozzle 1 at a minimum height H of less than 10 mm.

Figure 2C:
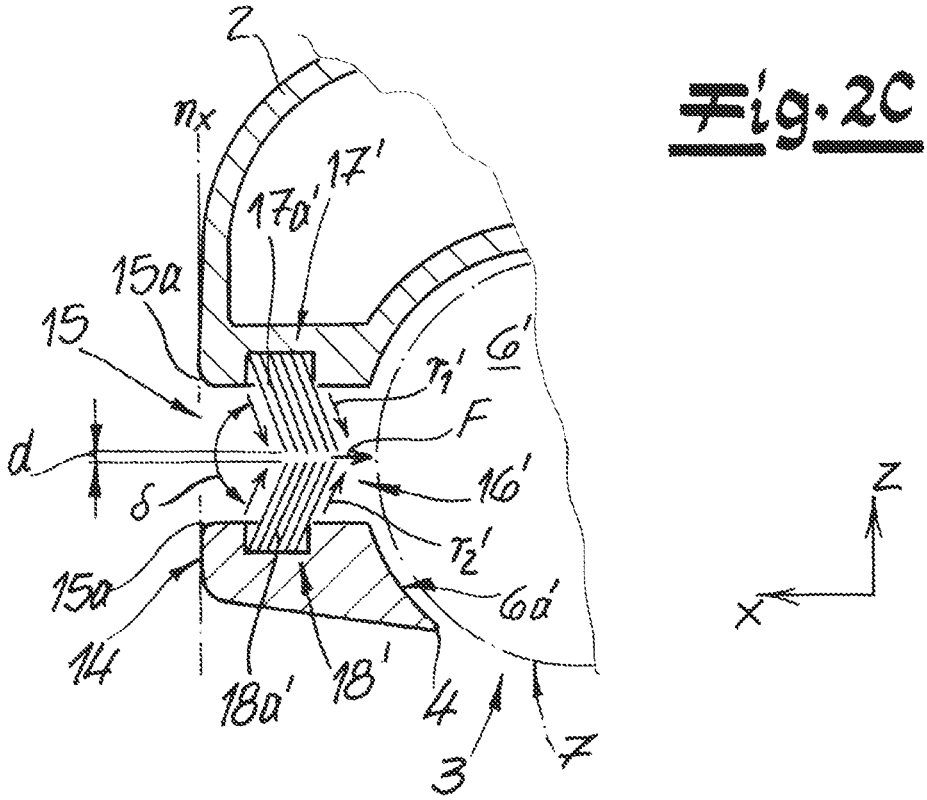
FIG. 2C shows an alternative embodiment of the detail from FIG. 2A.

In FIG. 2C, a detail from FIG. 2A is illustrated in an alternative embodiment. In contrast to the previously shown exemplary example, the first bristle strip 17' and the second bristle strip 18' are inclined inward in the flow direction F. In this case, the alignment $r_1'$ of the fibers 17*a*' of the first bristle strip 17' includes an angle δ of greater than 135° with the alignment $r_2'$ of the fibers 18*a*' of the second bristle strip 18'. This slight inward inclination facilitates the aperture of the air path in the flow direction F, because the fibers 17*a*', 18*a*' are made longer and thus offer a larger "lever arm" for the elastic bending. At the same time, a check valve, which prevents unintentional backflow when the pressure conditions are reversed, is formed in an advantageous manner against the flow direction F. Furthermore, the flexible textile valve element 16' of the further embodiment is disposed directly in a wall of the housing 2, which simultaneously forms an end face 14 and an inner wall 6*a*' of the suction duct 6'.

Although only a few embodiments of the present invention have been shown and described, it is to be understood that many changes and modifications may be made thereunto without departing from the spirit and scope of the invention.

What is claimed is:

1. A vacuum cleaner nozzle comprising:

a housing having an underside and a rear side;

a suction orifice formed on the underside of the housing and extending in a transverse direction, wherein the suction orifice is bounded in a working direction aligned perpendicular to the transverse direction by a front suction-orifice edge and by a rear suction-orifice edge;

a suction duct disposed in the housing and adjoining the suction orifice;

a suction port extension in fluid communication with the suction duct and disposed, relative to the working direction, on the rear side of the housing; and a secondary air aperture disposed in front of the suction orifice and in fluid communication with the suction duct;

wherein the secondary air aperture is covered at least partly by a flexible textile valve element.

2. The vacuum cleaner nozzle according to claim 1, wherein the secondary air aperture is formed in an end face of the housing.

3. The vacuum cleaner nozzle according to claim 1, wherein the secondary air aperture is bounded by a circumferential rim that extends exclusively in a plane aligned perpendicular to the working direction.

4. The vacuum cleaner nozzle according to claim 1, wherein the secondary air aperture is directly adjacent to the suction duct.

5. The vacuum cleaner nozzle according to claim 1, wherein the secondary air aperture has a minimum height of no more than 4 mm relative to a support plane of the vacuum cleaner nozzle.

6. The vacuum cleaner nozzle according to claim 1, wherein the flexible textile valve element has a large number of fibers.

7. The vacuum cleaner nozzle according to claim 6, wherein the fibers have a fineness of at most 4 dtex.

8. The vacuum cleaner nozzle according to claim 6, wherein the fibers are disposed with a bundle density of at least 50 fibers per $mm^2$.

9. The vacuum cleaner nozzle according to claim 6, wherein the fibers have at least one freely protruding end.

10. The vacuum cleaner nozzle according to claim 6, wherein at least some of the fibers are disposed without gaps and parallel to one other in a first bristle strip.

11. The vacuum cleaner nozzle according to claim 10, wherein the flexible textile valve element has at least one second bristle strip with fibers aligned without gaps and parallel to one other.

12. The vacuum cleaner nozzle according to claim 11, wherein the fibers of the first bristle strip and the fibers of the second bristle strip are aligned antiparallel to one another.

13. The vacuum cleaner nozzle according to claim 6, wherein the fibers are aligned perpendicular to a flow direction and/or to the working direction.

14. The vacuum cleaner nozzle according to claim 6, wherein the flexible textile valve element completely closes off the secondary air aperture.

15. The vacuum cleaner nozzle according to claim 6, wherein the flexible textile valve element has an extent of no more than 2 mm in the working direction and/or in a flow direction.

16. The vacuum cleaner nozzle according to claim 6, wherein the flexible textile valve element has an extent of no more than 1 mm in the working direction and/or in a flow direction.

* * * * *